US012295470B2

(12) United States Patent
Yang

(10) Patent No.: US 12,295,470 B2
(45) Date of Patent: May 13, 2025

(54) SMART DEVICE ATTACHABLE CARD HOLDER WITH HAND TOOLS

(71) Applicant: Ming Yang, Calgary (CA)

(72) Inventor: Ming Yang, Calgary (CA)

( * ) Notice: Subject to any disclaimer, the term of this patent is extended or adjusted under 35 U.S.C. 154(b) by 412 days.

(21) Appl. No.: 17/891,931

(22) Filed: Aug. 19, 2022

(65) Prior Publication Data

US 2024/0057735 A1 Feb. 22, 2024

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 150/147
See application file for complete search history.

(56) References Cited

U.S. PATENT DOCUMENTS

| | | | | |
|---|---|---|---|---|
| 4,667,374 | A * | 5/1987 | Bianchi | A44B 99/00 24/3.9 |
| 4,903,745 | A * | 2/1990 | Roman | A45F 5/02 224/667 |
| 9,768,822 | B1 * | 9/2017 | Loh | H04M 1/185 |
| 11,311,087 | B2 * | 4/2022 | Del Moral | A45C 1/06 |
| 2010/0122756 | A1 * | 5/2010 | Longinotti-Buitoni | A45C 11/00 150/165 |
| 2013/0037187 | A1 * | 2/2013 | D'Amore | A45C 15/00 150/147 |
| 2014/0251368 | A1 * | 9/2014 | Lawson | A45C 13/02 206/37 |
| 2016/0113368 | A1 * | 4/2016 | Tu | A45C 11/00 206/45.23 |
| 2016/0324285 | A1 * | 11/2016 | Zavala | A45C 11/321 |
| 2018/0235338 | A1 * | 8/2018 | Lamb | A45C 13/001 |
| 2019/0008253 | A1 * | 1/2019 | Deng | A45C 11/182 |
| 2019/0215388 | A1 * | 7/2019 | Cantoli-Alves | A45C 11/182 |
| 2019/0269212 | A1 * | 9/2019 | Swart | A45C 11/182 |
| 2019/0296788 | A1 * | 9/2019 | Zavala | A45C 11/321 |
| 2019/0298024 | A1 * | 10/2019 | Gandhi | A45C 11/00 |
| 2019/0375087 | A1 * | 12/2019 | Liang | A45C 1/06 |
| 2022/0087389 | A1 * | 3/2022 | Wulff | H01F 7/02 |
| 2023/0157430 | A1 * | 5/2023 | Backus | A45C 13/005 150/149 |
| 2023/0389668 | A1 * | 12/2023 | Zane | A45C 11/182 |

FOREIGN PATENT DOCUMENTS

| | | | | |
|---|---|---|---|---|
| FR | 2700929 | A3 * | 8/1994 | A45C 11/182 |
| KR | 101450311 | B1 * | 2/2014 | H04B 1/3816 |
| KR | 472435 | Y1 * | 4/2014 | H04B 1/3816 |

* cited by examiner

*Primary Examiner* — Don M Anderson
*Assistant Examiner* — Justin Caudill
(74) *Attorney, Agent, or Firm* — David & Raymond Patent Firm; Raymond Y Chan

(57) ABSTRACT

A smart device attachable card holder with hand tools includes a card holder case and a hand tool case. The card holder case has two or more independent card sockets, each positioning between a first attachable surface side and a second surface side thereof and having a drawing opening formed at one of four edge sides thereof, and two or more independent indention slots formed at the two or more drawing openings respectively. The hand tool case includes a mounting arrangement provided at a mounting surface side thereof and configured to be detachably attaching to the first attachable surface side of the card holder case, and at least one hand tool connected thereto.

11 Claims, 12 Drawing Sheets

SMART DEVICE ATTACHABLE CARD HOLDER WITH HAND TOOLS

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a card holder attachable to a smart device, and more particularly to a smart device attachable card holder with hand tools that allows the user to recognize each card retained in the card holder and withdraw each card easily and independently.

Description of Related Arts

In twenty century, cellular phones evolutes into smart devices each of which not only provides standard wireless phone function, but also can be functioned as multiple handheld devices such as GPS, television, monitor, computer, dictionary, electronic wallet, camera, video recorder, digital map, video conferencing means, browser, album, radio, audio recorder, AV player, calculator, online shopping means, controller of other electronic devices, and etc., depending which APP (application) is logged in in the smart device.

Practically, one may not carry his or her personal items such as wallet, keys, cash, notebook computer, or the like with him or her all the time, no matter indoor or outdoor, but one would always carry his or her smart device, so that he or she can communicate with the whole world, access required information and data, pay or receive money, and call or text with someone anytime and anywhere as long as there is a network. However, some cards are generally required to be carried along with a person, including picture identification (ID), driving license, credit cards, student card, and so on that are required to be presented to the authorities with true copies where image copies are not acceptable.

It is a user-friendly concept that if a card holder can be attached to an attachable surface SD1 of a smart device SD. A card holder with attachable means, such as "MagSafe" for iPhone as shown in FIG. 1A and FIG. 1B and phone case as shown in FIG. 1C, for detachably attaching to the attachable surface SD1 of the smart device SD is a popular smart device attachable accessory in the market. However, when multiple cards are required to be carried with user, the conventional smart device attachable card holder can generally retain the cards in an enlarged chamber. In order to prevent dropping out of the contained cards, a cover may additionally provide as shown in FIG. 1C. One shortcoming of the conventional smart device attachable card holder is that when the user would like to use a particular card, the user has to take out all the cards contained so as to select and pick the right card to use. Since the smart device attachable card holder is normally attached to an attachable surface of the smart device, the user is required to use two hands to hold the smart device, take out all the cards, pick up the particular card the user needs to use, and insert back the other cards back to the enlarged card chamber. It is especially inconvenient in an occasion that the user is carrying or doing something with one hand, such as carrying a briefcase or shopping bag, holding a child, driving a vehicle, and etc., the user has only one hand to operate the above procedures.

Further, the pressing of two or more contained cards directly together in the conventional card holder would cause rubbing and scratching of the card against the adjacent card, while inserting into and drawing from the receiving chamber of the card holder, that results in unwanted damages and causing malfunction to the contained cards.

Another shortcoming of the smart device attachable card holder is that criminals may access and steal the personal information of the contained cards through NFC (Near Field Communication) technology.

Further, some accessories are usually required to use with a smart device, such as touch pen or stylus pen for operating the touch screen of the smart device, sim card tray removal tool, phone stand, adapter, mini screwdriver, and the like. Accordingly, it would provide significant and substantial convenience to the smart device user if the smart device attachable card holder is equipped with one or more common accessories for the smart device.

SUMMARY OF THE PRESENT INVENTION

The invention is advantageous in that it provides a smart device attachable card holder with hand tools, which distinctively contains two or more cards allowing the user to precisely recognize each card and precisely draw out a particular card of the two or more cards to use with one hand.

Another advantage of the invention is to provide a smart device attachable card holder with hand tools, including a card holder case and a hand tool case which can be attached with each other to form an integral body for detachably attaching to an attachable surface of a smart device.

Another advantage of the invention is to provide a smart device attachable card holder with hand tools, including a card holder case and a hand tool each of which can be selectively attached to an attachable surface of a smart device.

Another advantage of the invention is to provide a smart device attachable card holder having two or more independent card sockets for retaining two or more cards respectively while each of the independent card sockets has an indention slot at a drawing opening thereof, allowing at least a portion of the contained card to be observable so that the user may easily recognize the card retained in that specific card socket.

Another advantage of the invention is to provide a smart device attachable card holder with hand tools, wherein the two or more card sockets have two or more independent indention slots at two or more sides of the card holder case respectively for card inserting therein and drawing out therefrom.

Another advantage of the invention is to provide a smart device attachable card holder with hand tools which is also attachable to the user's belt, hand bag, or etc.

Another advantage of the invention is to provide a smart device attachable card holder with hand tools which can prevent access of the information of the contained cards therein through NFC technology.

Another advantage of the invention is to provide a smart device attachable card holder which includes a built-in foldable stand for the smart device to be attached thereto.

Another advantage of the invention is to provide a smart device attachable card holder with hand tools, which card holder case includes at least one attaching arrangement at a first attaching surface side thereof configured for detachably attaching to an attachable surface of a smart device.

Another advantage of the invention is to provide a smart device attachable card holder with hand tools, which hand tool case includes a clip member configured not only for clipping to a belt like element but also for detachably holding an "AirTag" element in position, wherein the clipping member can be made detachable so that the user may select to have the clipping function or not for the hand tool case.

Another advantage of the invention is to provide a smart device attachable card holder with hand tools, which hand tool case includes a mounting arrangement at a mounting surface side thereof configured for detachably mounting to the second attaching surface side of the card holder case.

Another advantage of the invention is to provide a smart device attachable card holder with hand tools, which hand tools unit has at least one tool socket therein and comprises at least one hand tool connected thereto in such a manner that the at least one hand tool is received in the at least one tool socket when it is not being used normally and is able to be removed from the at least one tool socket when it is required to be used anytime.

Another advantage of the invention is to provide a smart device attachable card holder with hand tools, having a compact rectangular size and a relative light weight, adapted for attaching with the attachable surface of the smart device firmly and securely that allowing the user to grip and/or hold the smart device in a more firm and secure manner with one hand or both hands.

Another advantage of the invention is to provide a smart device attachable card holder with hand tools which prevents two adjacent cards contained therein from rubbing and scratching with each other to protect the contained cards from unnecessary and unexpected damages.

According to the present invention, the foregoing and other objects and advantages are attained by a smart device attachable card holder with hand tools, including:

a card holder case, having a first attachable surface side, a second surface side, four edge sides, two or more independent card sockets each positioning between the first attachable surface side and said second surface side and having a drawing opening formed at one of the four edge sides, and two or more independent indention slots formed at the two or more drawing openings respectively, wherein the card holder case includes an attaching arrangement provided at the first attachable surface side thereof and configured for detachably attaching to an attachable surface of a smart device; and a hand tool case, having a mounting surface side and at least one hand tool socket and comprising a mounting arrangement provided at the mounting surface side and configured to be detachably attaching to the first attachable surface side of the card holder case, and at least one hand tool connected thereto in such a manner that the at least one hand tool is selectively received in the at least one hand tool socket when not being used and removed from the at least one hand tool socket to use.

In one embodiment, the card holder case includes a hand tool housed therein. The card holder further has a tool socket provided at one of the four edge sides thereof and the hand tool, such as a foldable stand, is received in the tool socket and configured to be capable of extending out from the tool socket to form a stand.

In one embodiment, the smart device attachable card holder with hand tools further includes a clip member detachably mounted to the hand tool case and configured for clipping to a belt like element.

In one embodiment, the clip member is configured for detachably holding an "Airtag" element in position.

In one embodiment, the at least one hand tool of the hand tool case is selected from the group consisting of stylus pen, phone stand, sim-card tray removal tool, knife, cutter, screwdriver, opener, pointer, scissors, clamp, and etc.

In one embodiment, the smart device attachable card holder with hand tools further includes a cover panel configured to be selectively attached to the mounting surface of the hand tool case detachably, wherein the cover panel provides an outer card slot for holding a card thereon in position.

Still further objects and advantages will become apparent from a consideration of the ensuing description and drawings.

These and other objectives, features, and advantages of the present invention will become apparent from the following detailed description, the accompanying drawings, and the appended claims.

Figure 1A:
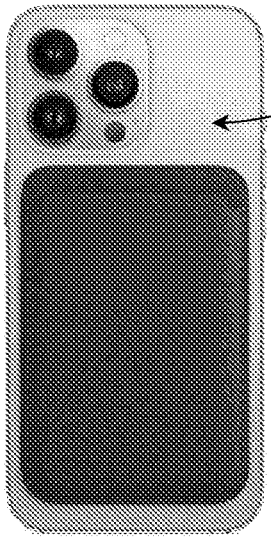
FIG. 1A (PRIOR ART)
FIGS. 1A-1C are schematic views of conventional card holders.

The drawings, described above, are provided for purposes of illustration, and not of limitation, of the aspects and features of various examples of embodiments of the invention described herein. The drawings are not intended to limit the scope of the claimed invention in any aspect. For simplicity and clarity of illustration, elements shown in the drawings have not necessarily been drawn to scale and the dimensions of some of the elements may be exaggerated relative to other elements for clarity.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 2 to FIG. 8B, a smart device attachable card holder with hand tools according to a preferred embodiment of the present invention is illustrated. The smart device attachable card holder includes a card holder case 10, a hand tool case 30 and a clip member 50 detachably mounted to the hand tool case 30.

Referring to FIG. 3A to FIG. 4B, the card holder case 10 has a first attachable surface side 110, a second surface side 120, four edge sides 101, 102, 103, 104, two or more independent card sockets 21, 22, 23 each of which is shaped and sized to fittingly receive a card such as credit card therein and has a drawing opening 211, 221, 231 formed at one respective edge side 101, 102, 103, and two or more independent indention slots 212, 222, 232 formed at the two or more drawings openings 211, 221, 231 respectively.

Figure 1B:
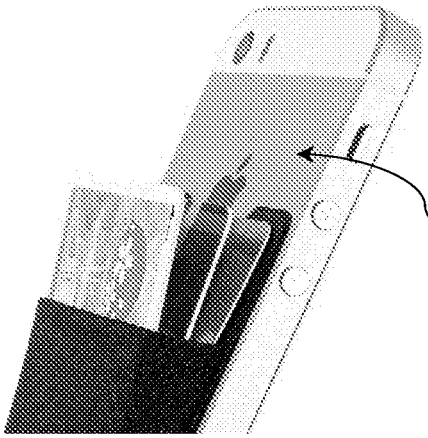
FIG. 1B (PRIOR ART)
Figure 1C:
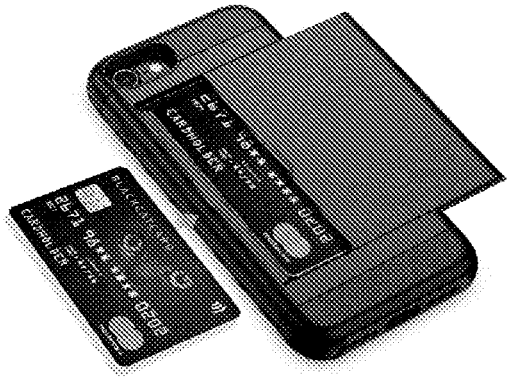
FIG. 1C (PRIOR ART)

The card holder case 10 includes an attaching arrangement 111 provided at the first attachable surface side 110 and configured for detachably attaching to an attachable surface SD1 of a smart device SD. For example, when the smart device SD is an iPhone as shown in FIG. 1A and FIG. 1B, the attaching arrangement 111 is embodied as a "MagSafe" adaptable arrangement adapted to be magnetically attached to the attachable surface SD1 of the iPhone SD.

Figure 4A:
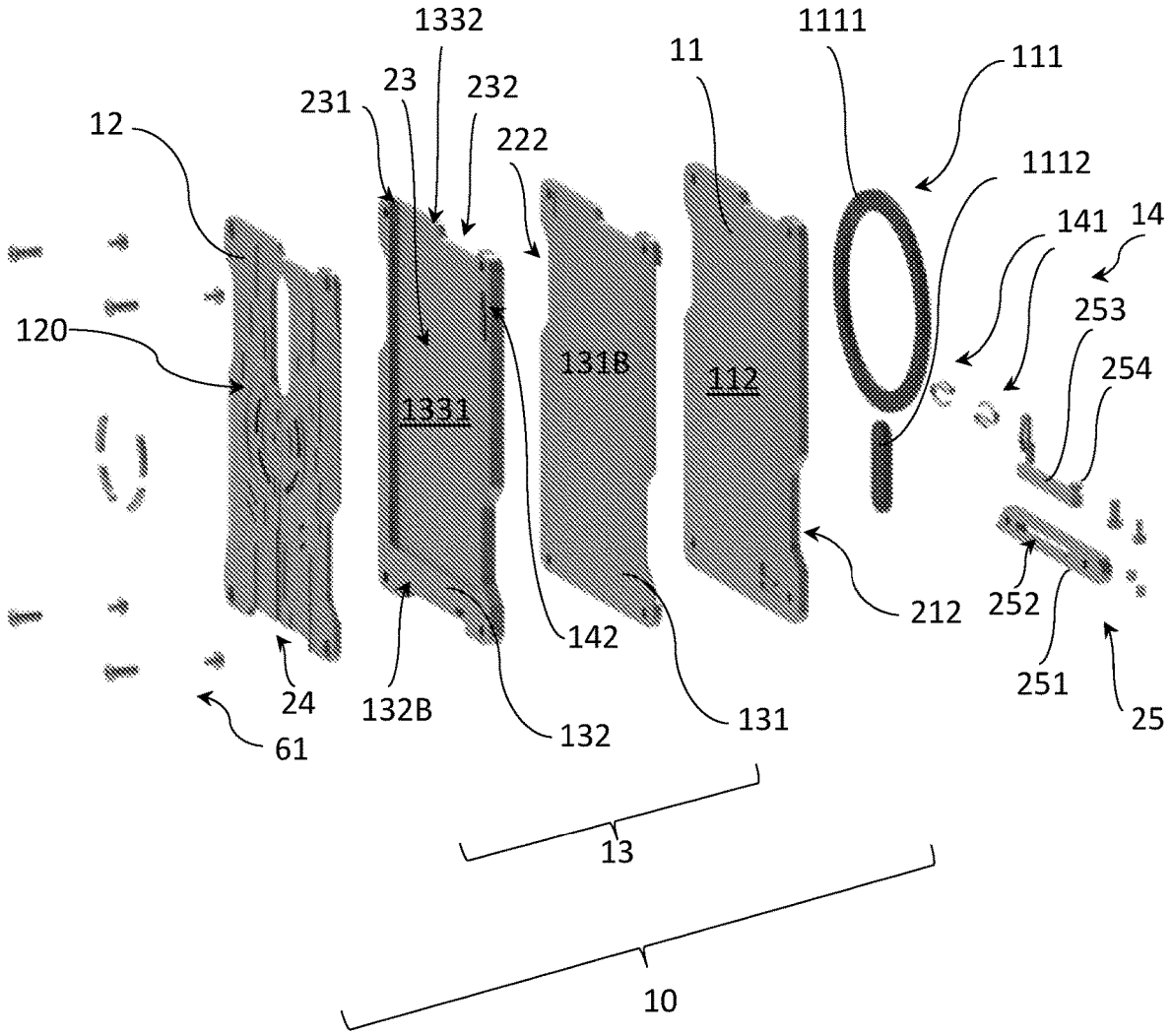
FIG. 4A is a front exploded view of the card holder case of the smart device attachable card holder according to the above preferred embodiment of the present invention.
Figure 4B:
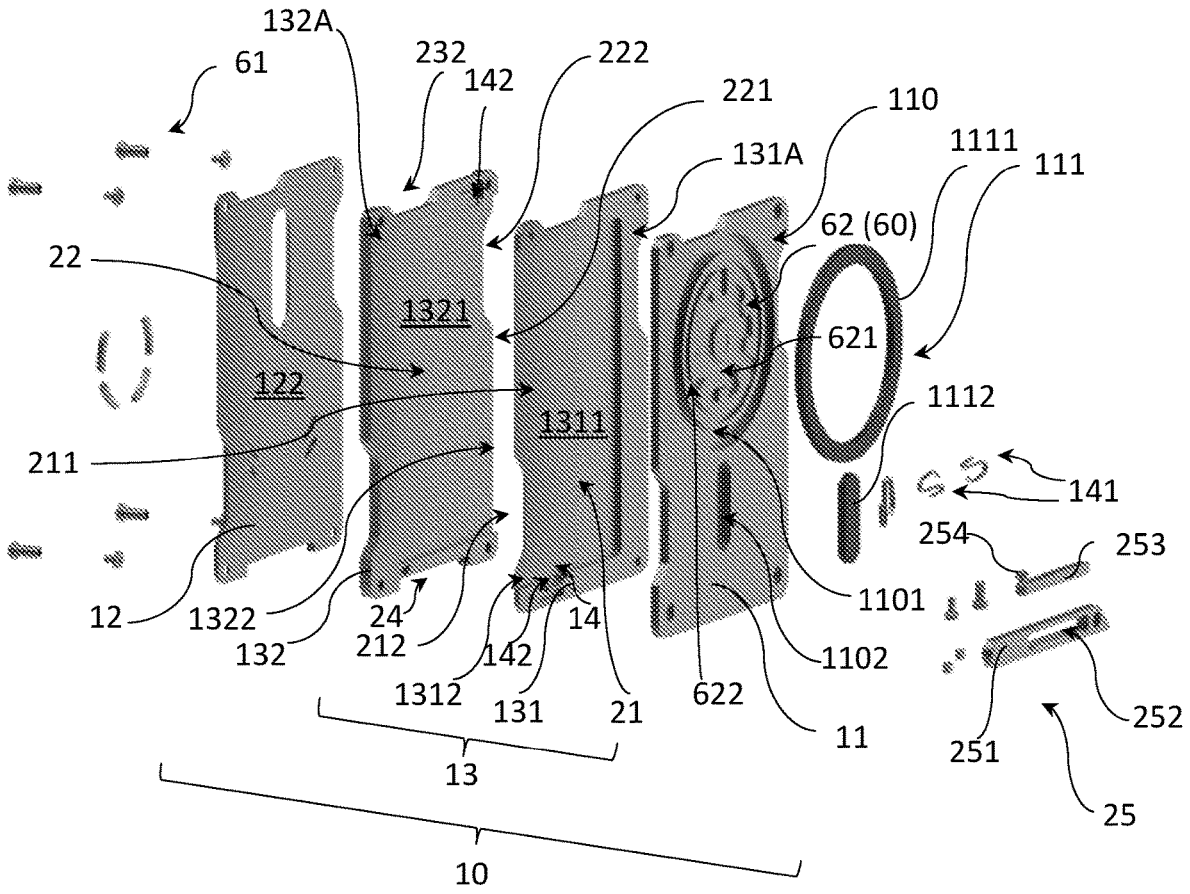
FIG. 4B is a rear exploded view of the card holder case of the smart device attachable card holder according to the above preferred embodiment of the present invention.

Referring to FIG. 4A and FIG. 4B, the card holder case 10 includes a first outer panel 11, a second outer panel 12 and a separator 13 provided between the first outer panel 11 and the second outer panel 12 defining the two or more card sockets 21, 22, 23 between the separator 13 and the first and second outer panels 11, 12 while the two or more drawing openings 211, 221, 231 of the two or more card sockets 21, 22, 23 are formed at two or more of the four edge sides 101, 102, 103, 104 respectively.

According to the preferred embodiment of the invention, there are first, second and third card sockets 21, 22, 23 and the separator 13 comprises a first inner panel 131 and a second inner panel 132 overlappedly mounted between the first outer panel 11 and the second outer panel 12, wherein the first card socket 21 is formed between the first outer panel 11 and the first inner panel 131, the second card socket 22 is formed between the first inner panel 131 and the second inner panel 132, and the third card socket 23 is formed between the second outer panel 12 and the separate 13, while the three drawing openings 211, 221, 231 of the first, second and third card sockets 21, 22, 23 are formed at the first edge side 101, the second edge side 102 and the third edge side 103 respectively. Also, there are three indention slots 212, 222, 232 which are three recesses indented at the first, second and third edge sides 101, 102, 103 respectively such that when three cards are fittingly received in the first, second and third card sockets 21, 22, 23, at least an edge portion of each of the three cards is exposed at the respective indention slots 212, 222, 232 which not only allows the user to recognize and identify the cards but also enables the user to easily and precisely insert the cards into the card sockets 21, 22, 23 respectively or to grip the particular card from the respective card socket 21, 22 or 23 through the indention slot 212, 222 or 232 thereof as desired.

The first and second outer panels 11, 12 and the first and second inner panels 131, 132 have similar sizes and are stacked and secured together to form an integral body by means of four sets of fasteners 61 at four corners of the card holder case 10.

In particular, as shown in FIG. 4A and FIG. 4B, the first inner panel 131 has a rectangular first recess 1311, sized for fittingly receiving a card therein, having a bottom wall, two side walls and a first opening 1312 at a longitudinal edge side of the first inner panel 131. An outer side of the first outer panel 11 forms the attachable surface side 110 and a flat inner side 112 of the first outer panel 11 attached on a recess side 131A of the first inner panel 131 facing the inner side 112 of the first outer panel 11 such that the first card socket 21 is defined by the first recess 1311 in the recess side 131A of the first inner panel 131 and the inner side 112 of the first outer panel 11, and the first opening 1312 forms the first drawing opening 211 of the first card socket 21.

The second inner panel 132 has a first side 132A and a second side 132B, wherein a rectangular second recess 1321, sized for fittingly receiving a card therein, is formed in the first side 132A, which has a bottom wall, two side walls and a second opening 1322 at a longitudinal edge side of the second inner panel 132. Another flat side 131B of the first inner panel 131 is attached to the first side 132A of the second inner panel 132 such that the second card socket 22 is defined by the second recess 1321 and the flat side 131B of the first inner panel 131 and the second opening 1322 forms the second drawing opening 221 of the second card socket 22. Further, a rectangular third recess 1331, sized for fittingly receiving a card therein, is formed in the second side 132B, which has a bottom wall, two side walls and a third opening 1332 at a top edge side of the second inner panel 132, wherein a flat inner side 122 of the second outer panel 12 is attached on the second side 132B of the second inner panel 132 such that the third card socket 23 is defined by the third recess 1331 and the inner side 122 of the second outer panel 12, and the third opening 1332 forms the third drawing opening 231 of the third card socket 23.

It is worth mentioning that the first and second outer panels 11, 12 are preferred to be made of light weight metal such as aluminum alloy or titanium, and that the first and second inner panels 131, 132 of the separator 13 can be made of insulating plastic or the similar metallic material of the first and second outer panels 11, 12. Of course, the first and second outer panels 11, 12 and the first and second inner panels 131, 132 are able to be made of other materials according to the needs of specific users.

Accordingly, the first and second inner panels 131, 132 of the separator 13 integrally mounted between first and second outer panels 11, 12 significantly isolate the three cards contained in the first, second and third card sockets 21, 22, 23 provided between first and second outer panels 11, 12, which not only prevents any contained card from rubbing and scratching with another contained card to protect the contained cards from unnecessary and unexpected damages, but also prevents access of the information of the contained cards through NFC technology.

In addition, in order to facilitate the drawing out of the desire card from the specific card socket 21, 22, 23, the first, second and third drawing openings 211, 221, 231 of the first, second and third card sockets 21, 22, 23 are formed at the right and left edge sides 101, 102 and the top edge side 103 of the card holder case 10, thereby the insertion and drawing out of each particular card from each of the first, second and third card sockets 21, 22 or 23 would not affect the other two cards contained in the other two card sockets 21, 22 or 23. Also, the first, second and third indention slots 212, 222, 232 are indented at the first, second and third edge sides 101, 102, 103 of the card holder case 10, that not only allows at least an edge portion of each contained card is observable thereby the user can easily identify and recognize the card retained in that specific card socket 21, 22, 23, but also enables the user to easily and precisely insert the cards into the card sockets 21, 22, 23 respectively or to grip the particular card from the respective card socket 21, 22 or 23 through the indention slot 212, 222 or 232 thereof as desired.

Figure 3A:
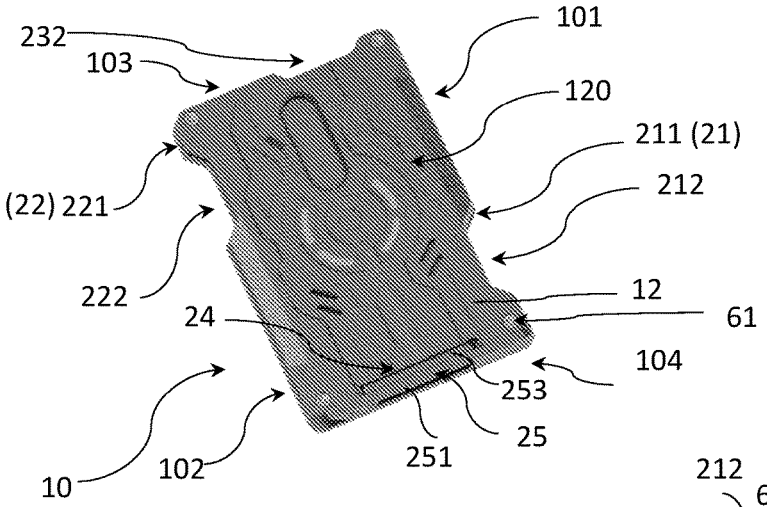
FIG. 3A is a perspective view of a card holder case of the smart device attachable card holder according to the above preferred embodiment of the present invention.

According to the present invention, referring to FIG. 3A to FIG. 4B, the card holder case 10 further has a tool socket 24 in the fourth edge side 104, i.e. the bottom edge side, thereof and comprises a hand tool 25 received in the tool socket 24. The hand tool 25 can be a stylus pen, touch pen, pointer or a sim card tray removal tool and the tool socket 24 is made to fittingly and detachably retained the hand tool 25 in position such that the user can pull out the hand tool 25 from the tool socket 24 anytime to use. According to the preferred embodiment, the hand tool 25 is embodied as a foldable stand which comprises a stand bar 251 having a guiding slot 252 therein and an extending arm 253 which has one end pivotally connected to the bottom edge side of the second inner panel 132 of the card holder case 10 and another end pivotally connected with the stand bar 251 through a slidable engagement of a rotatable guider 254 and the guiding slot 252, such that the extending arm 253 and the stand bar 251 are able to be folded overlappingly to be received in the tool socket 24 as shown in FIG. 3A and unfolded to extend the stand bar 251 out of the tool socket 24 in a triangular configuration as shown in FIG. 3B and FIG. 3D. By unfolding and extending out the stand bar 251, the card holder case 10 attached to attachable surface SD2 of the smart device SD can be functioned as a stand to assist the smart device SD to steadily stand on a supporting surface.

In order to ensure the card securely retained in the respective card socket 21, 22, 23, as shown in FIG. 4A and FIG. 4B, a retainer arrangement 14 is arranged at a side wall of each of the first, second and third recesses 1311, 1321, 1331 of the first and second inner panels 131, 132. Each of the retainer arrangements 14 comprises a S-shape retainer spring 141 installed in a retaining slot 142 formed at the side wall each of the first, second and third recesses 1311, 1321, 1331 of the first and second inner panels 131, 132, such that the retainer spring 141 mounted in said retaining slot 142 provides a resilient retaining force against the card received in the respective card socket 21, 22, 23 to retain the card in position, and that while a drawing force is applied to pull the portion of the contained card exposed at the respective indention slot 212, 222, 232, the retaining force is overcome and the retainer spring 141 provides a resilient force to facilitate the contained card to be drawn out from the respective card socket 21, 22, 23.

Referring to FIGS. 5A, 6-7B, the smart device attachable card holder of the present invention further includes a hand tool case 30 having a mounting surface side 301, an outer surface side 302 and at least one hand tool socket 341, 342 or 343. The hand tool case 30 comprises a mounting arrangement 41 provided at the mounting surface side 301 and configured to be detachably attaching to the first attachable surface side 110 of the card holder case 10 and at least one hand tool 42 connected thereto in such a manner that the at least one hand tool 42 is received in the at least one hand tool socket 341, 342 or 343 when not being used and being able to be removed from that at least one hand tool socket 341, 342 or 343 to use.

According to the preferred embodiment, the hand tool case 30 includes a first panel 31, a second panel 32 and a supporting panel 33 mounted between the first and second panels 31, 32 by means of four sets of fasteners 35 fastening at four corners thereof to form an integral body. The supporting panel 33 has a first receiving slot 331, a second receiving slot 332 and a third receiving slot 333 at two longitudinal sides and a bottom side thereof respectively, such that three hand tool sockets 341, 342, 343 are defined by the first, second and third receiving slots 331, 332, 333 respectively after the first and second panels 31, 32 are securely mounted on two sides of the supporting panel 33. As shown in FIG. 7B, the second receiving slot 332 further has an elongated slot 334 upwardly extended from the second receiving slot 332 for receiving a pen body 4211 of a stylus pen 421 as one of the at least one hand tool 42.

Figure 6:
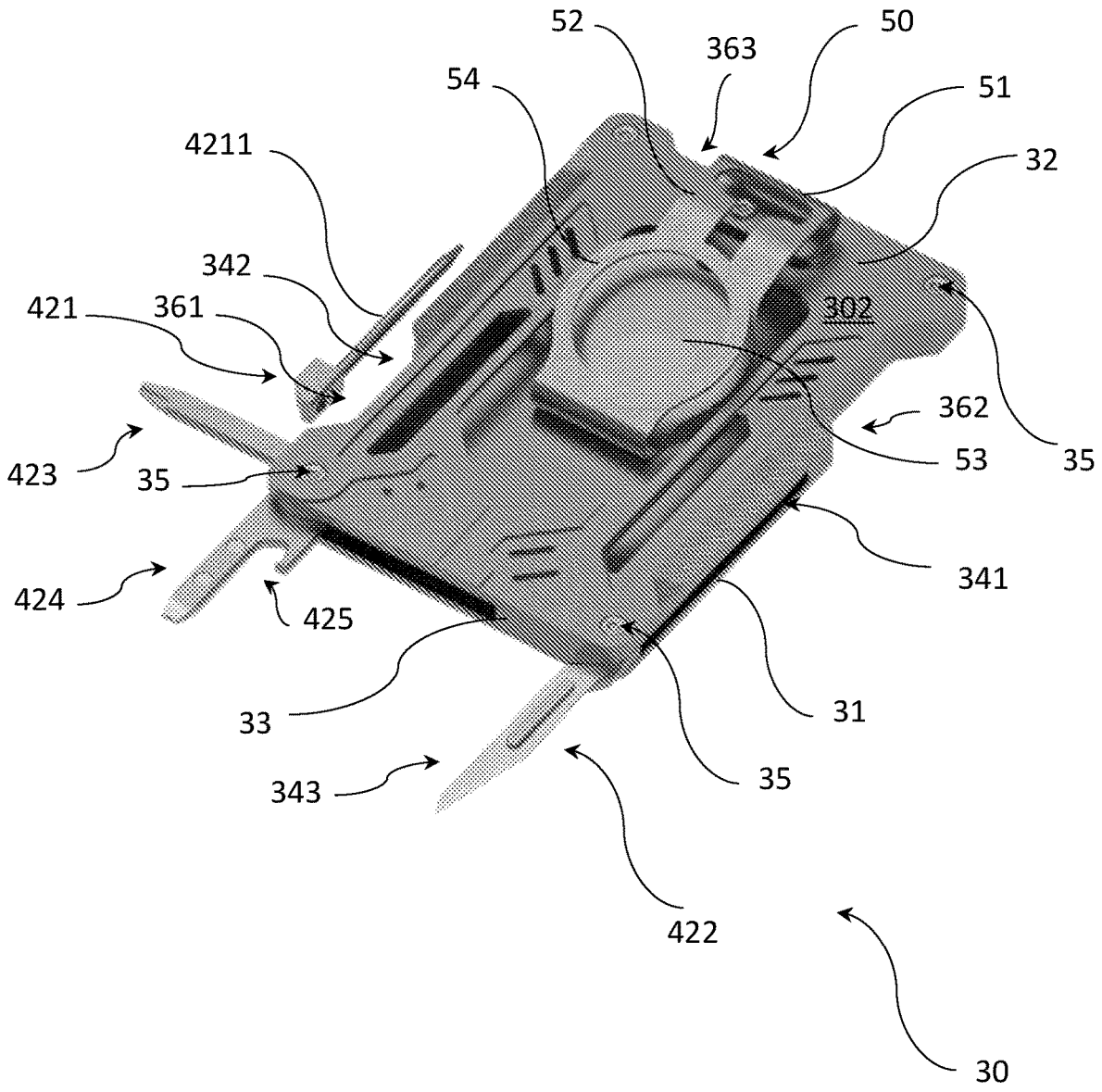
FIG. 6 is rear perspective view of the hand tool case of the smart device attachable card holder according to the above preferred embodiment of the present invention, illustrating the hand tools thereof in extended state.

According to the preferred embodiment of the present invention, besides the stylus pen 421, the at least one hand tool 42 further includes a knife 422, a Philips screwdriver 423 and a slotted screwdriver 424 built in with an opener 425. The knife 422 is pivotally connected to hand tool case 30 by means of one set of the fastener 35 in such a manner that the knife 422 is capable of pivotally folding inward to be received in the first hand tool socket 341 when it is not in use and to pivotally unfolded outward to be extended as shown in FIG. 6 for use. The Philips screwdriver 423 and the slotted screwdriver 424 are both pivotally connected to the hand tool case 30 by means of another set of the fasteners 35 in such a manner that the Philips screwdriver 423 is pivotally folding inward to be received in the second hand tool socket 342 when it is not in use and to pivotally unfold outward to be extended as shown in FIG. 6 for use, while the slotted screwdriver 424, with the opener 425, is pivotally folding inward to be received in the third hand tool socket 343 when it is not in use and to pivotally unfold outward to be extended as shown in FIG. 6 for use.

Figure 9:
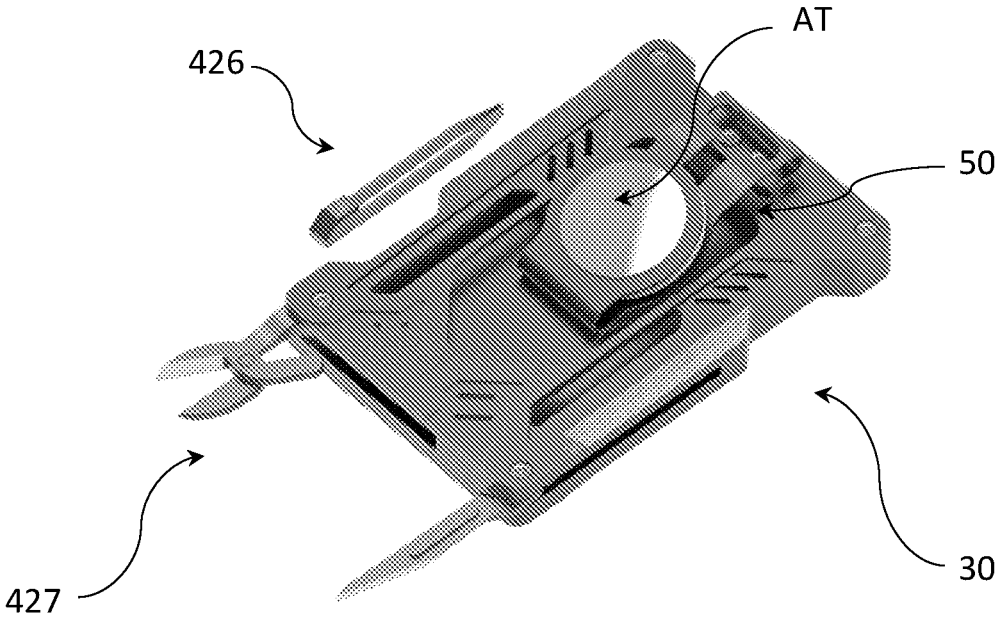
FIG. 9 is an alternative mode of the hand tool case of the smart device attachable card holder according to the above preferred embodiment of the present invention.

Referring to FIG. 6, The clip member 50 detachably mounted to the hand tool case 30 is configured for clipping to a belt like element. According to the preferred embodiment, the clip member 50 includes a connector 51 screwed to an upper portion of the second panel 32 of the hand tool case 30, a clipper 52, a resilient arm 53 extended between the connector 51 and the clipper 52 so as to provide resilient pressing ability to the clipper 52, and a ring shape holder 54 integrally extended from the clipper 52 and positioned on top of the clipper 52 for holding an "AirTag" element AT (as shown in FIG. 9) in position.

Generally, the hand tool case 30 can be clipped to the user's belt or a belt of the user's handbag by the clip member 50 or to mount to a pocket of the user or in the user's handbag or briefcase. When the card holder case 10 is detached from the user's smart device, the card holder case 10 can be attached to the hand tool case 30 by attaching the first attachable surface side 110 of the card holder case 10 to the mounting surface side 301 of the hand tool case 30 through a magnetic attachment between the attaching arrangement 111 of the card holder case 10 and the mounting arrangement 41 of the hand tool case 30.

According to the preferred embodiment, the attaching arrangement 111 is preferred to be configured to work with the MagSafe of an iPhone as the smart device, wherein "MagSafe" is a proprietary, magnetically attached wireless power transfer and accessory-attachment standard developed by Apple Inc. for its iPhone and AirPods. To be adaptable with the "MagSafe" and the magnetic attachable arrangement provided in the attachable surface of other current smart device SD, the attaching arrangement 111 includes a magnetic attaching ring 1111 which is made with an opposing magnetic pole with respect to the magnetic pole of the MagSafe so as to ensure secure magnetic attachment of the card holder case 10 on the attachable surface SD1 of the iPhone as the smart device SD and a magnetic alignment member 1112. Correspondingly, as shown in FIG. 4B, the first attachable surface side 110 of the card holder case 10 is further provided with a ring slot 1101 indented at an upper portion thereof and a member slot 1102 indented at a lower portion thereof, such that the magnetic attaching ring 1111 and magnetic alignment member 1112 are fittingly and fixedly mounted in the ring slot 1101 and the member slot 1102 respectively, while ensuring a flat surface of the attachable surface side 110 for flatly and tightly attaching on the attachable surface SD1 of the smart device SD magnetically.

Figure 2:
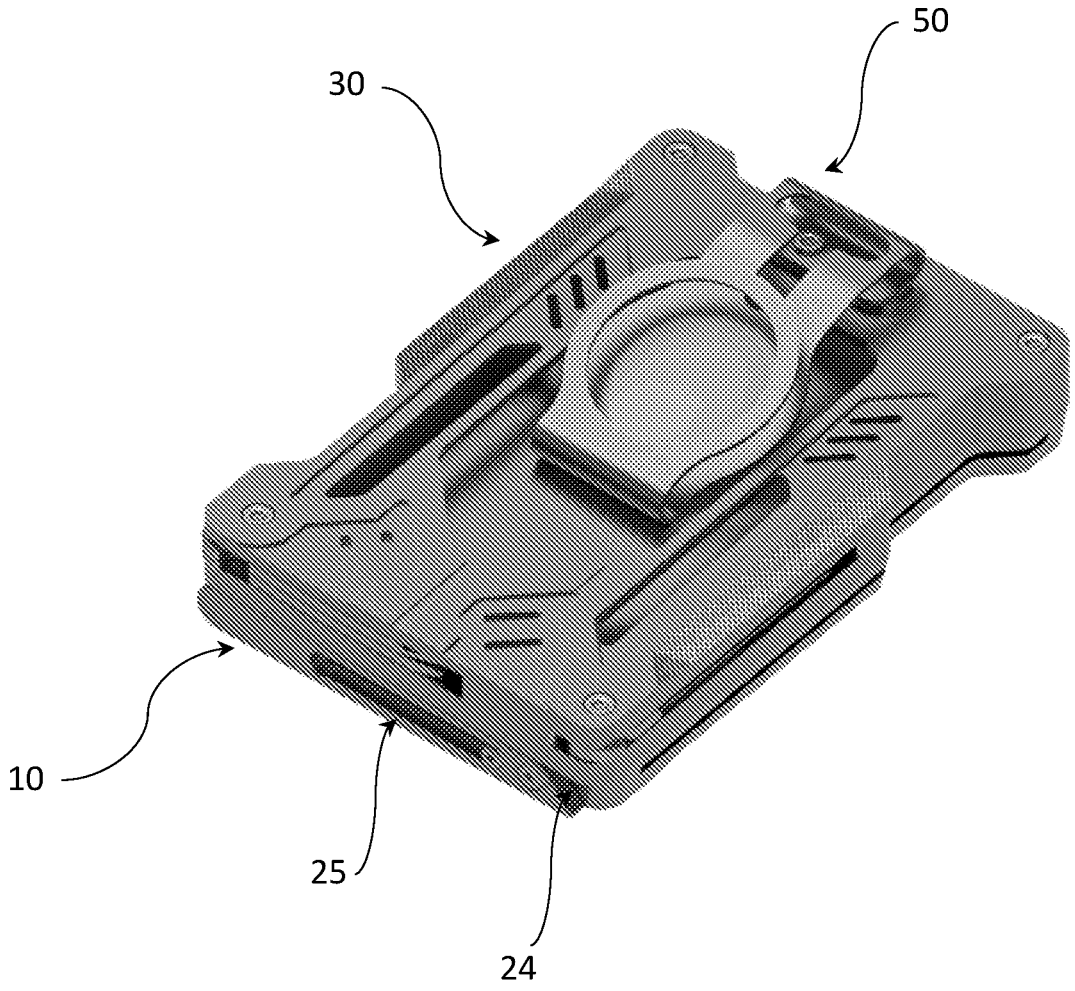
FIG. 2 is a perspective view of a smart device attachable card holder according to a preferred embodiment of the present invention.
Figure 5A:
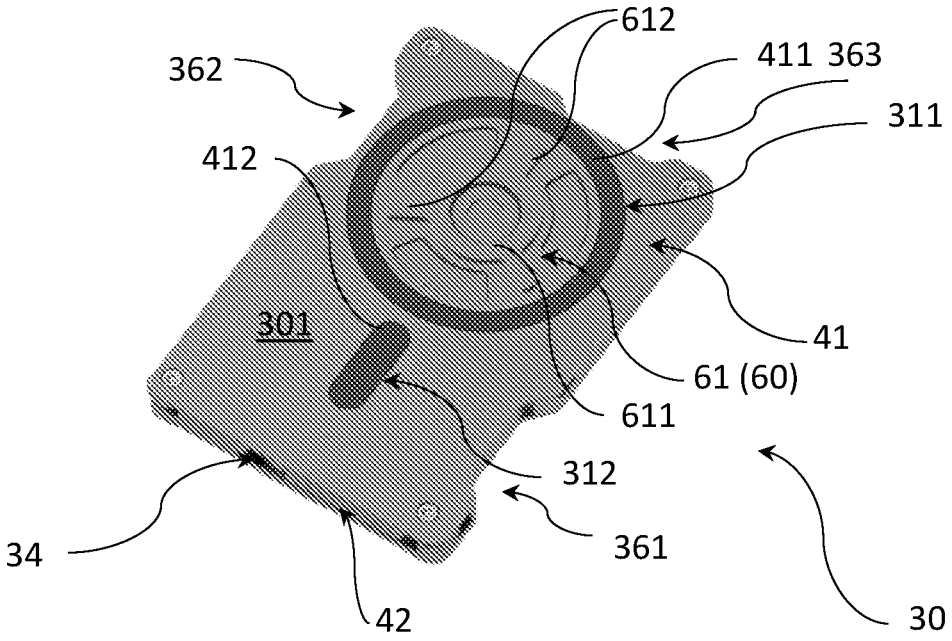
FIG. 5A is a front perspective view of a hand tool case of the smart device attachable card holder according to the above preferred embodiment of the present invention.
Figure 7A:
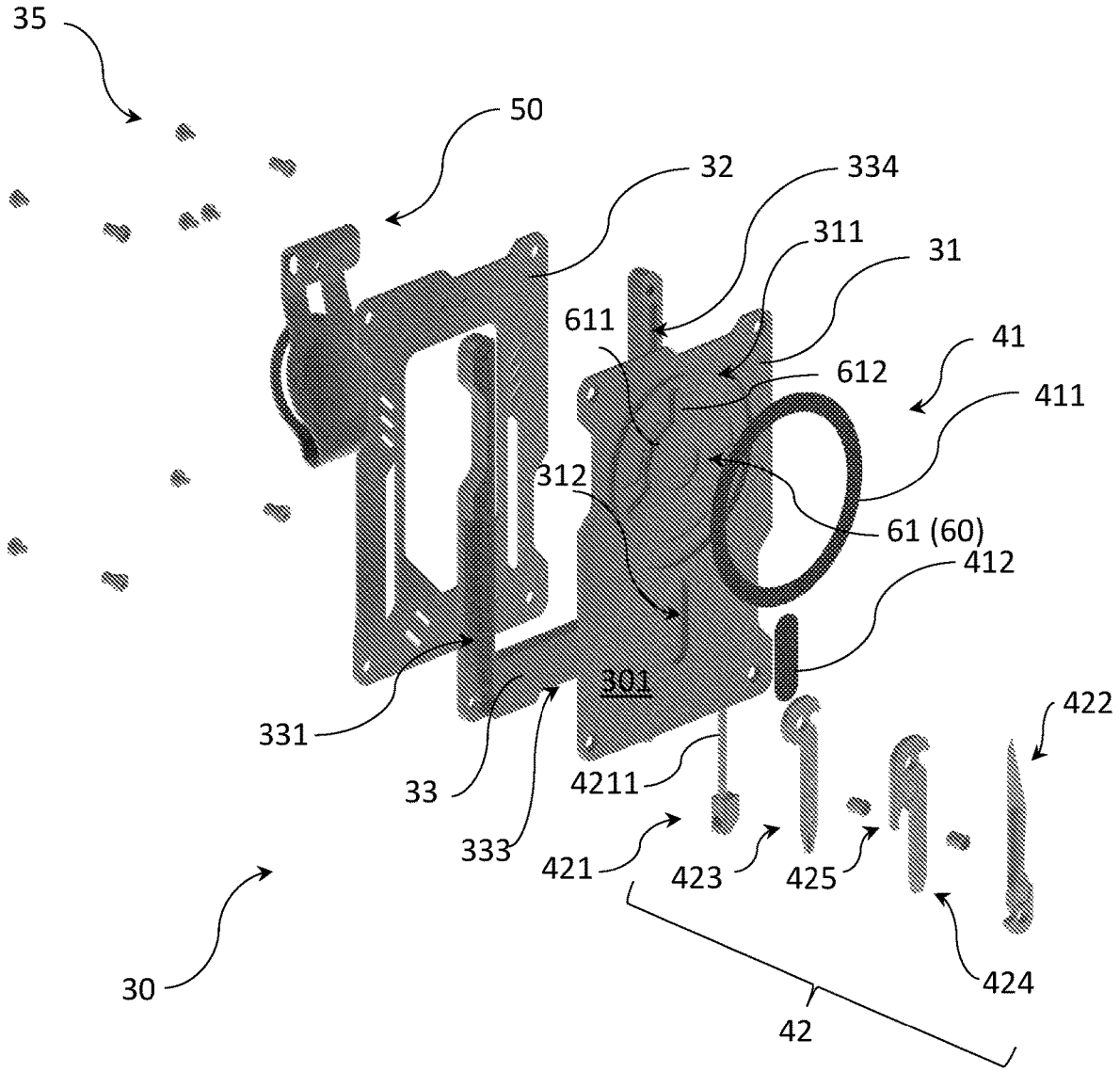
FIG. 7A is a front exploded view of the hand tool case of the smart device attachable card holder according to the above preferred embodiment of the present invention.
Figure 7B:
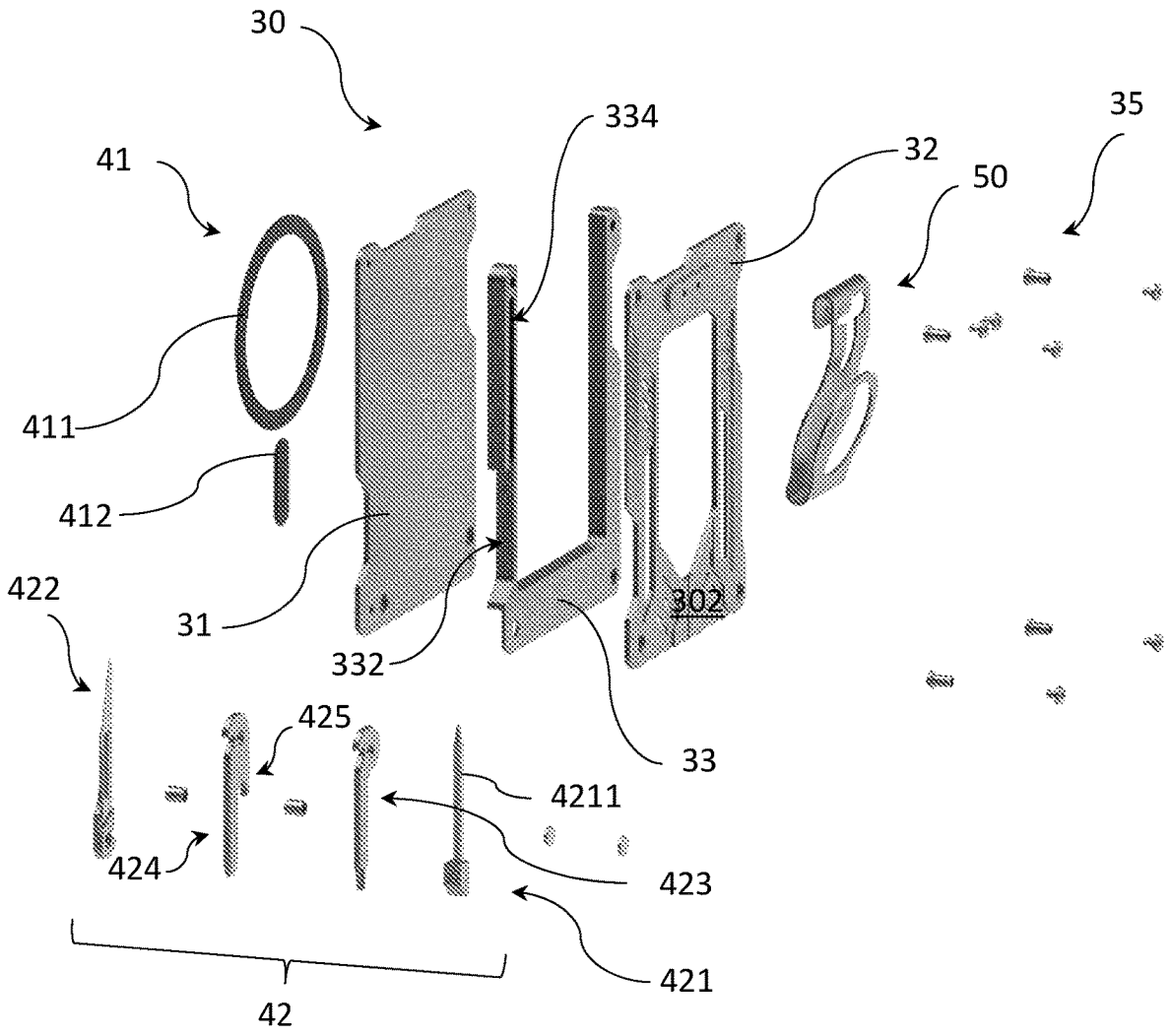
FIG. 7B is a rear exploded view of the hand tool case of the smart device attachable card holder according to the above preferred embodiment of the present invention.

With respect to the attaching arrangement 111 of the card holder case 10, as shown in FIGS. 5A, 7A and 7B the mounting arrangement 41 of the hand tool case 30 also includes a magnetic mounting ring 411 and an alignment mounting member 412 shaped and sized corresponding to the magnetic attaching ring 1111 and the alignment member 1112 of the attaching arrangement 111 of the card holder case 10. Similarly, the mounting surface side 301 of the hand tool case 30, i.e. an outer side of the first panel 31, is also provided with a mounting ring slot 311 and a mounting member slot 312 indented therein, wherein the magnetic mounting ring 411 and the alignment mounting member 412 are fittingly and fixedly mounted in the mounting ring slot 311 and the mounting member slot 312 respectively, as show in FIG. 7A. It is appreciated that the magnetic pole of the magnetic attaching ring 1111 and the alignment member 1112 with respect to the magnetic pole of the magnetic mounting ring 411 and the alignment mounting member 412 are opposite so as to ensure a secure magnetic attachment therebetween while the alignment member 1112 and the alignment mounting member 412 are well provided to guide and ensure the card holder case 10 being aligned and attached to the hand tool case 30 in the desire upright manner. Thereby, when the card holder case 10 is not attached to the phone, the user may simply dock and attach the card holder case 10 with the hand tool case 30 as shown in FIG. 2.

Figure 3B:
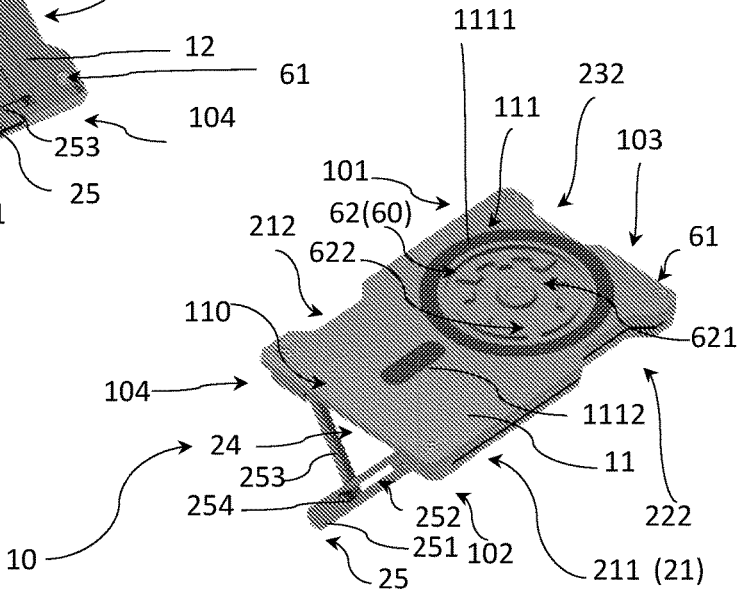
FIG. 3B is another perspective view of the card holder case of the smart device attachable card holder according to the above preferred embodiment of the present invention, illustrating the foldable stand in an extended state.
Figure 3D:
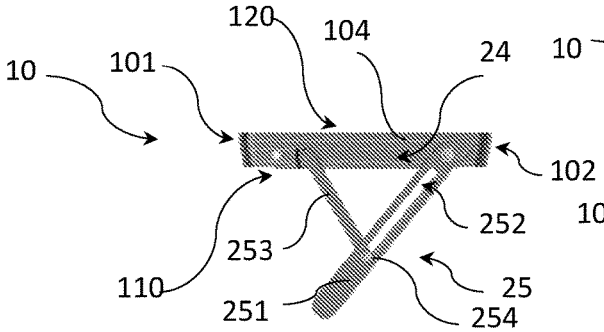
FIG. 3D is a bottom view of the card holder case of the smart device attachable card holder according to the above preferred embodiment of the present invention.
Figure 3C:
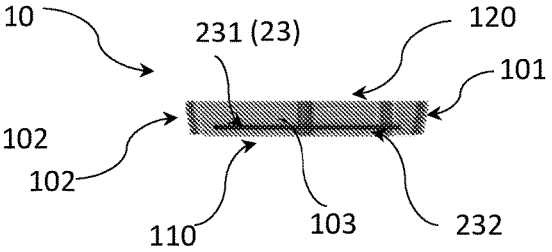
FIG. 3C is a top view of the card holder case of the smart device attachable card holder according to the above preferred embodiment of the present invention.

For more secure connection between the card holder case 10 and the hand tool case 30, an engagement arrangement 60 is provided, as shown in FIG. 5A and FIG. 7A, which comprises an embedding configuration 61 integrally protruded in center portion of the mounting surface side 301 of the hand tool case 30, i.e. an outer side of the first panel 31, encircling by the mounting ring slot 311. Preferably, the embedding configuration 61 comprises a ring-shape central base element 611 and at least one finger element 612 extended from the base element 611, preferably three finger elements 612 radially extended, in A shape, from the base element 611 with equally spaced angle therebetween. Correspondingly, the engagement arrangement 60 further comprises an embedded configuration 62 integrally indented in a center portion of the attachable surface side 110 of the card holder case 10, i.e. the outer side of the first outer panel 11, encircling by the ring slot 1101, as shown in FIG. 3B and FIG. 4B. Preferably, the embedded configuration 62 comprises a ring-shape base groove 621 and at least one finger groove 622 extended from the base groove 621, preferably three finger grooves 622 radially extended, in A shape, from the base groove 621 with equally spaced angle therebetween. Accordingly, the embedding configuration 61 is shaped and sized to be embedded in the embedded configuration 62 so as to interlock and engage the card holder case 10 with the hand tool case 30 more securely to prevent the card holder case 10 from sliding off from the hand tool case 30.

Figure 5B:
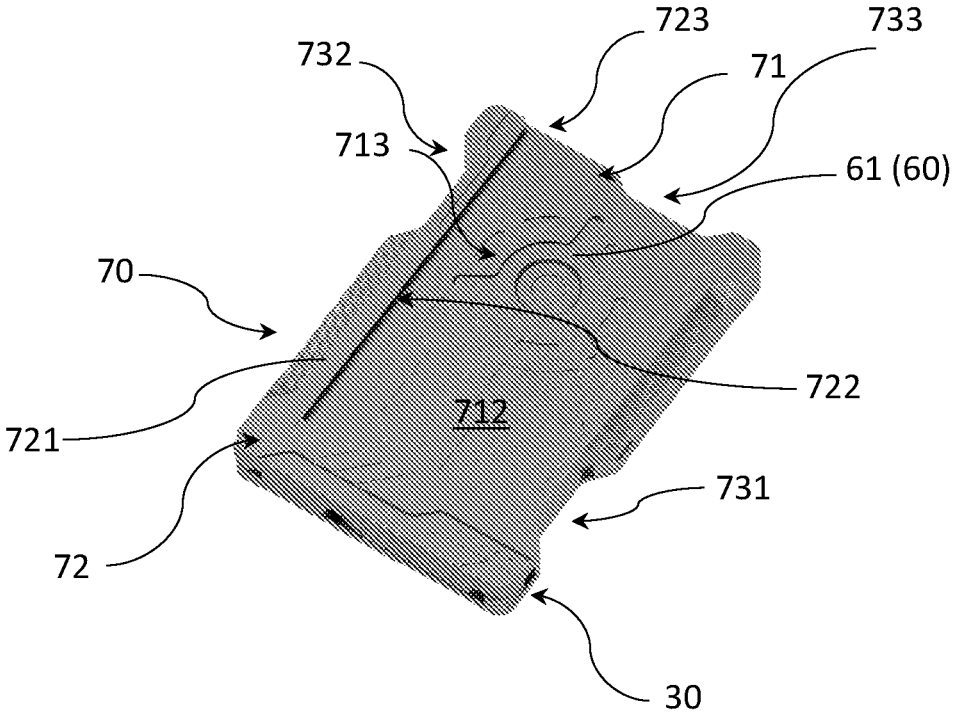
FIG. 5B is a front perspective view of the hand tool case with a cover panel attached thereon according to the above preferred embodiment of the present invention.
Figure 8A:
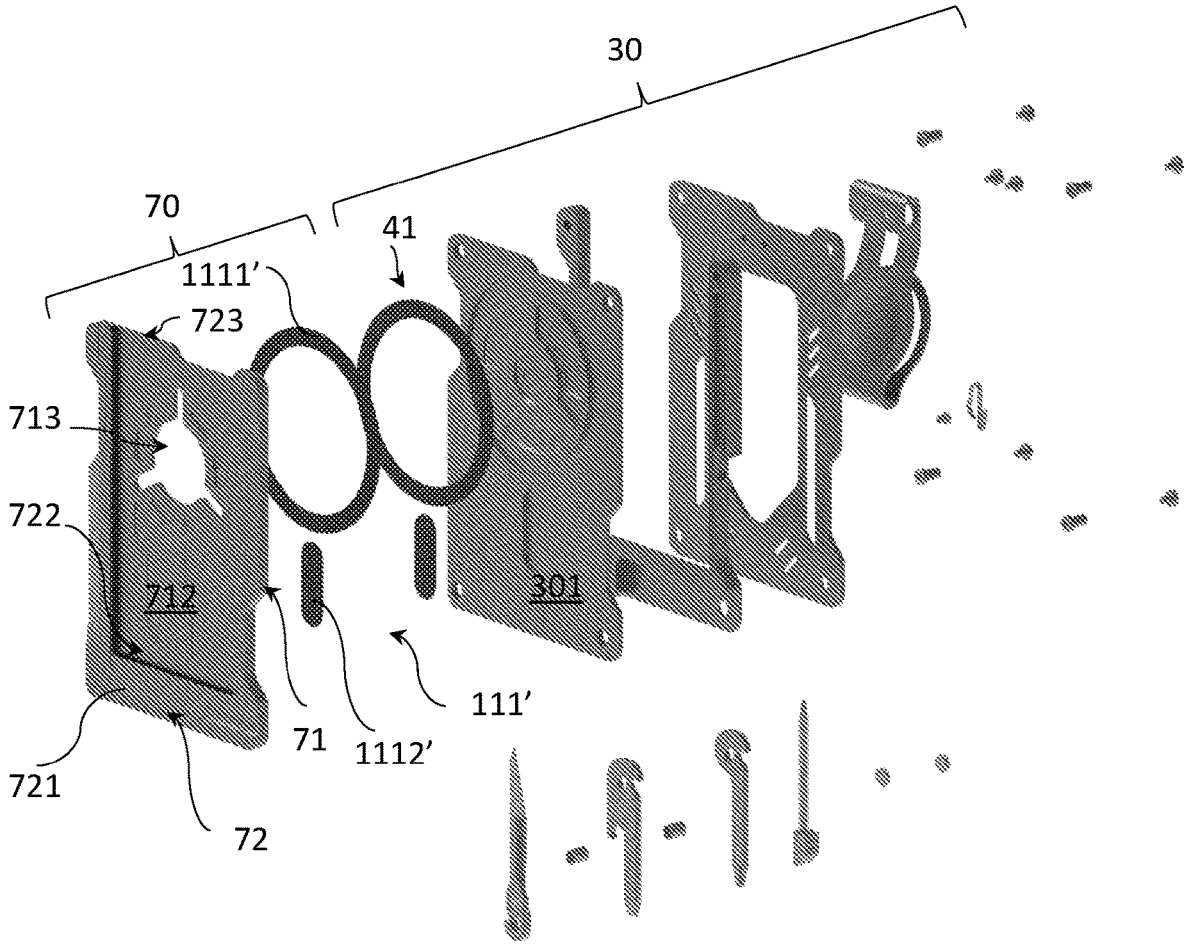
FIG. 8A is a front exploded view of the hand tool case and the cover panel of the smart device attachable card holder according to the above preferred embodiment of the present invention.
Figure 8B:
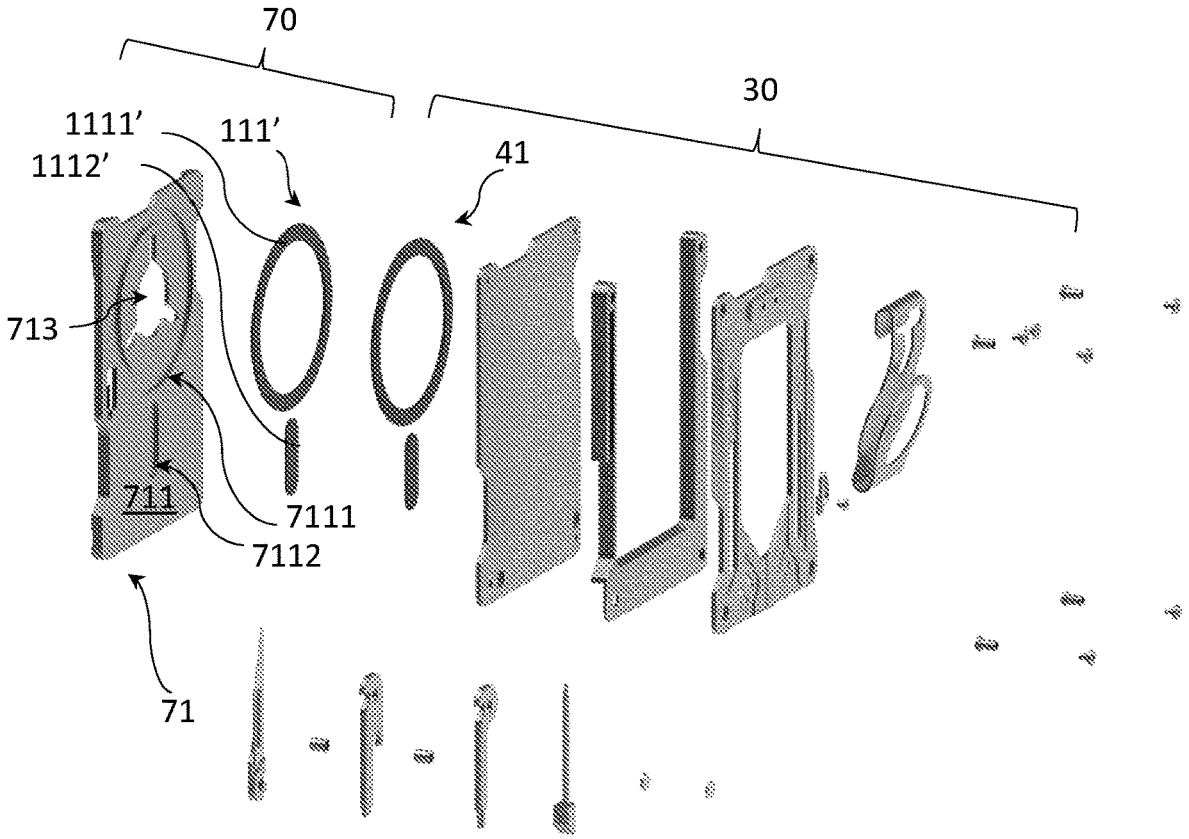
FIG. 8B is a rear exploded view of the hand tool case and the cover panel of the smart device attachable card holder according to the above preferred embodiment of the present invention.

According to the preferred embodiment of the present invention, as shown in FIG. 5B and FIGS. 8A-8B, the smart device attachable card holder of the present invention further comprises a cover case 70 configured to be attached to the mounting surface side 301 of the hand tool case 30 when the card holder case 10 is not attached to the mounting surface side 301 of the hand tool case 30. The cover case 70 comprises a cover panel 71, having an inner side 711, an outer side 712, comprises a cover attaching arrangement 111' provided on the inner side 711 adapted to be magnetically attached with the mounting arrangement 41 of the hand tool case 30 and a card holder 72 provided on the outer side 712 of the cover panel 71.

The cover attaching arrangement 111', which is preferred to have the same configuration as the attaching arrangement 111 of the card holder case 10, comprises a magnetic attaching ring 1111' and a magnetic alignment member 1112'. The cover panel 71 is further provided with a cover ring slot 7111 indented at an upper portion of the inner side 711 thereof and a cover member slot 7112 indented at a lower portion of the inner side 711 thereof, such that the magnetic attaching ring 1111' and the alignment member 1112' are fittingly and fixed mounted in the cover ring slot 7111 and the cover member slot 7112 respectively, while ensuring a flat surface of the inner side for flatly and tightly attaching on the mounting surface side 301 of the hand tool case 30. Encircling by the cover ring slot 7111, an embedded opening 713 is formed and shaped to fit in the embedding configuration 61 of the hand tool case 30 while the cover panel 71 is attached on the mounting surface side 301 of the hand tool case 30.

Referring to FIG. 5B and FIG. 8A, The card holder 72 comprises a U-shaped holding rim 721, having a L-shaped cross section, integrally extended along two longitudinal edge side and a bottom edge side of the outer side 712 of the cover panel 71 to define a L-shape holding slot 722 having a top opening 723, such a card such as entrance security card, identification card, employee card, or student card which content information is required to be observed and accessed from outside can be placed on the outer side 712 through the top opening 723 and being held in position by the holding slot 722, such that the cover case 70 can be detached from the hand tool case 30 anytime to be used to being scanned or pass to an authority when required and reattached to the hand tool case 30 simply snapping back to the mounting surface side 301 of the hand tool case 30.

Both the hand tool case 30 and the cover case 70 also provide three hand tool case indention slots 361, 362, 363 at the left and right edge sides and the top edge side of the hand tool case 30 (as shown in FIG. 5A and FIG. 6) and three cover case indention slots 731, 732, 733 at the left and right edge sides and the top edge side of the cover case 70 (as shown in FIG. 5B) with respect to the size, shape and position of the three indention slots 212, 222, 232 of the card holder case 10, so that when the card holder case 10 is attached with the hand tool case 30 or the cover case 70, the coinciding of the indention slots 212, 222, 232 and the hand tool case indention slots 361, 362, 363 and/or the cover case indention slots 731, 732, 733 facilitates the user to place the cards in the card sockets 21, 22, 23, to recognize and identify the cards received in the card sockets 21, 22, 23, and draw out the cards from the card sockets 21, 22, 23.

It is worth mentioning that the hand tool case 30 and the cover case 70 are preferred to be made of light weight metal such as aluminum alloy or titanium or insulating plastic material. Of course, the hand tool case 30 and the cover case 70 are able to be made of other materials according to the needs of specific users.

It is appreciated that the introduction of the inventive concept according to description of the above preferred embodiment is for illustration purpose but not intending to limit the claims of the invention and can be modified into alternatives, including but not limited to the following:

(i) the attaching arrangement 111 can also be provided on the second surface side 120 of the card holder case 10;

(ii) both the first surface side 110 and the second surface side 120 of the card holder case 10 are provided with the attaching arrangement 111 so that the card holder case 10 can be magnetically attached to the attachable surface of a smart device while the hand tool case 30 can also be magnetically attached to the card holder case 10;

(iii) similarly both the mounting surface side 301 and the outer surface side 302 of the hand tool case 30 are provided with the mounting arrangement 41;

(iv) the mounting arrangement 41 may also be configured to be attachable to the attachable surface SD1 of the smart device SD so as to allow the smart device user carrying his or her smart device SD with the hand tool case 30 in one piece;

(v) the drawing openings 211, 221, 231 of the first, second and third card sockets 21, 22, 23 can be selectively formed at the four edge sides 101, 102, 103, 104 according to the actual requirement of the user;

(vi) one of the first and second inner panels 131, 132 of the card holder case 10 can be replaced with the supporting panel 33 of the hand tool case 30, so that the card holder case 10 may carry more hand tools 42 with the smart device SD;

(vii) one or more of the first and second inner panels 131, 132 may be mounted between the first and second panels 31, 32 of the hand tool case 30 so as to also provide card holder purpose for the hand tool case 30;

(viii) the positions of the indention slots 212, 222, 232, the hand tool case indention slots 361, 362, 363 and the cover case indention slots 731, 732, 733 can be formed at any position along the left and right edge sides and the top edge sides of the card holder case 10, hand tool case 30 and the cover case 70 respectively; and (ix) more hand tool sockets can be formed in the hand tool case 30 to receive various hand tools according to the requirement of the manufacturer and the user.

Referring to FIG. 9, an alternative mode of the hand tool case 30 is illustrated, wherein the screwdrivers and stylus pen are replaced by other hand tools such as a clip 426 and a scissors 427. Also, the "AirTag" element AT is detachably retained by the clip member 50.

Figure 10:
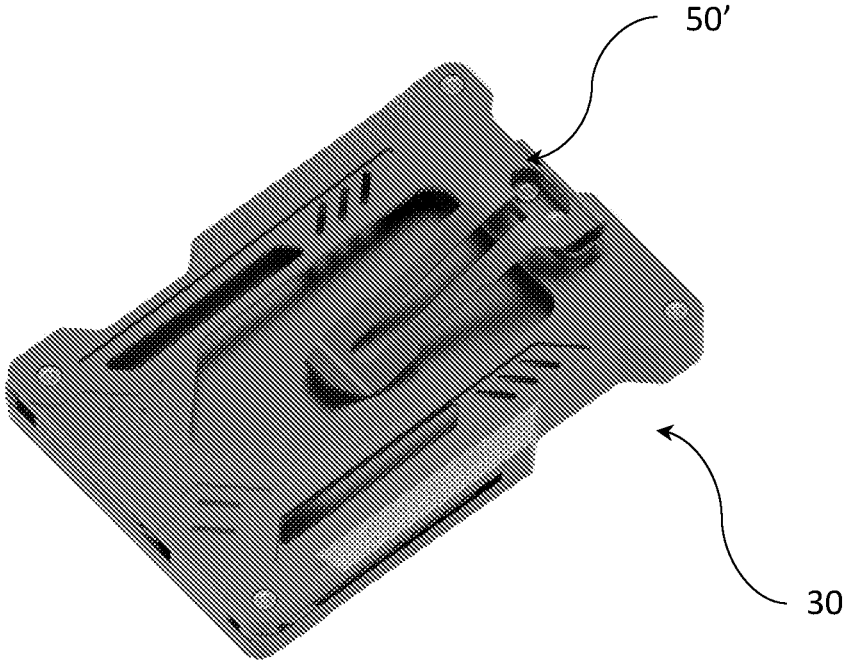
FIG. 10 is another alternative mode of the hand tool case of the smart device attachable card holder according to the above preferred embodiment of the present invention.

Referring to FIG. 10, another alternative mode of the hand tool case 30 is illustrated, wherein an alternative clip member 50' is mounted thereto.

It is worth mentioning that the smart device attachable card holder of the present invention, which has a compact rectangular size and a relative light weight, is adapted for attaching with the attachable surface of the smart device firmly and securely that allowing the user to grip and/or hold the smart device in a more firm and secure manner with one hand or both hands. The independent card sockets 21, 22, 23 of the card holder case 10 not only prevents two adjacent cards contained therein from rubbing and scratching with each other to protect the contained cards from unnecessary and unexpected damages, but also prevents access of the information of the contained cards therein through NFC technology.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A smart device attachable card holder adapted for detachably attaching to an attachable surface of a smart device, including:

a card holder case, having a first attachable surface side, a second surface side, first, second, third and fourth edge sides, two or more independent card sockets each positioned between said first attachable surface side and said second surface side and each of said two or more independent card slots having a drawing opening formed at one of said first, second, third and fourth edge sides, and two or more independent indention slots formed at said two or more drawing openings respectively, wherein said card holder case includes an attaching arrangement provided at said first attachable surface side thereof and configured for detachably attaching to the attachable surface of the smart device, wherein said card holder case includes a first outer panel, a second outer panel and a separator provided between said first outer panel and said second outer panel defining said two or more card sockets between said separator and said first and second outer panels while said two or more drawing openings of said two or more card sockets are formed at two or more of said four edge sides respectively, wherein said two or more card sockets include a first card socket, a second card socket and a third card socket, and said separator includes a first inner panel and a second inner panel overlappedly mounted between said first outer panel and said second outer panel, wherein said first card socket is formed between said first outer panel and said first inner panel, said second card socket is formed between said first inner panel and said second inner panel, and said third card socket is formed between said second outer panel and said second inner panel, wherein said two or more drawing openings include a first drawing opening of said first card socket, a second drawing opening of said second card socket and a third drawing opening of said third card socket, which are formed at said first edge side, said second edge side and said third edge side respectively, wherein said two or more indention slots include a first indention slot, a second indention slot and a third indention slot which are indented at said first edge side, said second edge side and said third edge side respectively, such that when three cards are received in said first card socket, said second card socket and said third card socket respectively, edge portions of the three cards are exposed at said first indention slot, said second indention slot and said third indention slot respectively, that not only allows recognition and identification of the three cards but also enables inserting and drawing of the three cards through said first indention slot, said second indention slot and said third indention slot respectively; and at least one hand tool housed in said smart device attachable card holder.

2. The smart device attachable card holder, as recited in claim 1, wherein said first inner panel has a rectangular first recess which has a first opening at a longitudinal edge side of said first inner panel, wherein an outer side of said first outer panel forms said attachable surface side and a flat inner side of said first outer panel attached on a recess side of said first inner panel facing said inner side of said first outer panel such that said first card socket is defined by said first recess in said recess side of said first inner panel and said inner side of said first outer panel, and said first opening forms said first drawing opening of said first card socket, wherein said second inner panel has a first side and a second side, wherein a rectangular second recess is formed in said first side, which has a second opening at a longitudinal edge side of said second inner panel, wherein another flat side of said first inner panel is attached to said first side of said second inner panel such that said second card socket is defined by said second recess and said flat side of said first inner panel and said second opening forms said second drawing opening of said second card socket, wherein a rectangular third recess which has a third opening at a top edge side of said second inner panel, wherein a flat inner side of said second outer panel is attached on said second side of said second inner panel such that said third card socket is defined by said third recess and said inner side of said second outer panel and said third opening forms said third drawing opening of said third card socket.

3. The smart device attachable card holder, as recited in claim 2, wherein a retainer arrangement is arranged at a side wall of each of said first recess, said second recess and said third recess for retaining the card received in each of said first card socket, said second card socket and said third card socket in position, and that while a drawing force is applied to pull the card, the retaining force is overcome and a resilient force is provided by said retainer arrangement to facilitate the card to be drawn out from each of said first card socket, said second card socket and said third card socket.

4. A smart device attachable card holder adapted for detachably attaching to an attachable surface of a smart device, including:

a card holder case, having a first attachable surface side, a second surface side, first, second, third and fourth edge sides, two or more independent card sockets each positioned between said first attachable surface side and said second surface side and each of said two or more independent card slots having a drawing opening formed at one of said first, second, third and fourth edge sides, and two or more independent indention slots formed at said two or more drawing openings respectively, wherein said card holder case includes an attaching arrangement provided at said first attachable surface side thereof and configured for detachably attaching to the attachable surface of the smart device, wherein said card holder case further has a tool socket provided at one of said four edge sides thereof and said at least one hand tool is a foldable stand received in said tool socket and configured to be capable of extending out from said tool socket to form a stand for said card holder case, wherein said card holder case includes a first outer panel, a second outer panel and a separator provided between said first outer panel and said second outer panel defining said two or more card sockets between said separator and said first and second outer panels while said two or more drawing openings of said two or more card sockets are formed at two or more of said four edge sides respectively, wherein said two or more card sockets include a first card socket, a second card socket and a third card socket, and said separator includes a first inner panel and a second inner panel overlappedly mounted between said first outer panel and said second outer panel, wherein said first card socket is formed between said first outer panel and said first inner panel, said second card socket is formed between said first inner panel and said second inner panel, and said third card socket is formed between said second outer panel and said second inner panel, wherein said two or more drawing openings include a first drawing opening of said first card socket, a second drawing opening of said second card socket and a third drawing opening of said third card socket, which are formed at said first edge side, said second edge side and said third edge side respectively, wherein said two or more indention slots include a first indention slot, a second indention slot and a third indention slot which are indented at said first edge side, said second edge side and said third edge side respectively, such that when three cards are received in said first card socket, said second card socket and said third card socket respectively, edge portions of the three cards are exposed at said first indention slot, said second indention slot and said third indention slot respectively, that not only allows recognition and identification of the three cards but also enables inserting and drawing of the three cards through said first indention slot, said second indention slot and said third indention slot respectively; and a hand tool case, which has a mounting surface side and at least one hand tool socket, and includes a mounting arrangement provided at said mounting surface side and configured to be detachably attaching to said first attachable surface side of said card holder case, and at least one hand tool configured to be selectively received in said at least one hand tool socket and removed from said at least one hand tool socket.

5. The smart device attachable card holder, as recited in claim 4, wherein said first inner panel has a rectangular first recess which has a first opening at a longitudinal edge side of said first inner panel, wherein an outer side of said first outer panel forms said attachable surface side and a flat inner side of said first outer panel attached on a recess side of said first inner panel facing said inner side of said first outer panel such that said first card socket is defined by said first recess in said recess side of said first inner panel and said inner side of said first outer panel, and said first opening forms said first drawing opening of said first card socket, wherein said second inner panel has a first side and a second side, wherein a rectangular second recess is formed in said first side, which has a second opening at a longitudinal edge side of said second inner panel, wherein another flat side of said first inner panel is attached to said first side of said second inner panel such that said second card socket is defined by said second recess and said flat side of said first inner panel and said second opening forms said second drawing opening of said second card socket, wherein a rectangular third recess which has a third opening at a top edge side of said second inner panel, wherein a flat inner side of said second outer panel is attached on said second side of said second inner panel such that said third card socket is defined by said third recess and said inner side of said second outer panel and said third opening forms said third drawing opening of said third card socket.

6. The smart device attachable card holder, as recited in claim 5, wherein a rectangular third recess which has a third opening at a top edge side of said second inner panel, wherein a flat inner side of said second outer panel is attached on said second side of said second inner panel such that said third card socket is defined by said third recess and said inner side of said second outer panel and said third opening forms said third drawing opening of said third card socket, wherein a retainer arrangement is arranged at a side wall of each of said first recess, said second recess and said third recess for retaining the card received in each of said first card socket, said second card socket and said third card socket in position, and that while a drawing force is applied to pull the card, the retaining force is overcome and a resilient force is provided by said retainer arrangement to facilitate the card to be drawn out from each of said first card socket, said second card socket and said third card socket.

7. The smart device attachable card holder, as recited in claim 4, wherein said hand tool case includes a first panel, a second panel and a supporting panel mounted between said first panel and said second panel, wherein said supporting panel has a first receiving slot, a second receiving slot and a third receiving slot at two longitudinal sides and a bottom side thereof respectively, wherein said at least one hand tool socket includes a first hand tool socket, a second hand tool socket and a third hand tool socket which are defined by said first receiving slot, said second receiving slot and said third receiving slot respectively after said first panel and said second panel are securely mounted on two opposing sides of said supporting panel, wherein said at least one hand tool includes a first hand tool, a second hand tool and a third hand tool configured to be received in said first hand tool socket, said second hand tool socket and said third hand tool socket respectively, wherein at least one of said first hand tool, said second hand tool and said third hand tool is detachably received in one of said first hand tool socket, said second hand tool socket and said hand tool socket, and at least one of said first hand tool, said second hand tool and said third hand tool is a foldable hand tool pivotally connected to said hand tool case in such a manner that said foldable hand tool is able to be folded and received in one of said first hand tool socket, said second hand tool socket and said third hand tool socket when being not used and unfolded to extend out for use.

8. The smart device attachable card holder, as recited in claim 5, wherein said first inner panel has a rectangular first recess which has a first opening at a longitudinal edge side of said first inner panel, wherein an outer side of said first outer panel forms said attachable surface side and a flat inner side of said first outer panel attached on a recess side of said first inner panel facing said inner side of said first outer panel such that said first card socket is defined by said first recess in said recess side of said first inner panel and said inner side of said first outer panel, and said first opening forms said first drawing opening of said first card socket, wherein said second inner panel has a first side and a second side, wherein a rectangular second recess is formed in said first side, which has a second opening at a longitudinal edge side of said second inner panel, wherein another flat side of said first inner panel is attached to said first side of said second inner panel such that said second card socket is defined by said second recess and said flat side of said first inner panel and said second opening forms said second drawing opening of said second card socket, wherein a rectangular third recess which has a third opening at a top edge side of said second inner panel, wherein a flat inner side of said second outer panel is attached on said second side of said second inner panel such that said third card socket is defined by said third recess and said inner side of said second outer panel and said third opening forms said third drawing opening of said third card socket, wherein said hand tool case includes a first panel, a second panel and a supporting panel mounted between said first panel and said second panel, wherein said supporting panel has a first receiving slot, a second receiving slot and a third receiving slot at two longitudinal sides and a bottom side thereof respectively, wherein said at least one hand tool socket includes a first hand tool socket, a second hand tool socket and a third hand tool socket which are defined by said first receiving slot, said second receiving slot and said third receiving slot respectively after said first panel and said second panel are securely mounted on two opposing sides of said supporting panel, wherein said at least one hand tool includes a first hand tool, a second hand tool and a third hand tool configured to be received in said first hand tool socket, said second hand tool socket and said third hand tool socket respectively, wherein at least one of said first hand tool, said second hand tool and said third hand tool is detachably received in one of said first hand tool socket, said second hand tool socket and said hand tool socket, and at least one of said first hand tool, said second hand tool and said third hand tool is a foldable hand tool pivotally connected to said hand tool case in such a manner that said foldable hand tool is able to be folded and received in one of said first hand tool socket, said second hand tool socket and said third hand tool socket when being not used and unfolded to extend out for use.

9. The smart device attachable card holder, as recited in claim 6, wherein said hand tool case includes a first panel, a second panel and a supporting panel mounted between said first panel and said second panel, wherein said supporting panel has a first receiving slot, a second receiving slot and a third receiving slot at two longitudinal sides and a bottom side thereof respectively, wherein said at least one hand tool socket includes a first hand tool socket, a second hand tool socket and a third hand tool socket which are defined by said first receiving slot, said second receiving slot and said third receiving slot respectively after said first panel and said second panel are securely mounted on two opposing sides of said supporting panel, wherein said at least one hand tool includes a first hand tool, a second hand tool and a third hand tool configured to be received in said first hand tool socket, said second hand tool socket and said third hand tool socket respectively, wherein at least one of said first hand tool, said second hand tool and said third hand tool is detachably received in one of said first hand tool socket, said second hand tool socket and said hand tool socket, and at least one of said first hand tool, said second hand tool and said third hand tool is a foldable hand tool pivotally connected to said hand tool case in such a manner that said foldable hand tool is able to be folded and received in one of said first hand tool socket, said second hand tool socket and said third hand tool socket when being not used and unfolded to extend out for use.

10. The smart device attachable card holder, as recited in claim 9, wherein said hand tool case further includes a clip member detachably mounted thereto, wherein said clip member has a ring shape holder for retaining an element in position.

11. A smart device attachable card holder adapted for detachably attaching to an attachable surface of a smart device, including:

a card holder case, having a first attachable surface side, a second surface side, first, second, third and fourth edge sides, two or more independent card sockets each positioning between said first attachable surface side and said second surface side and having a drawing opening formed at one of said first, second, third and fourth edge sides, and two or more independent indention slots formed at said two or more drawing openings respectively, wherein said card holder case includes an attaching arrangement provided at said first attachable surface side thereof and configured for detachably attaching to the attachable surface of the smart device; and a hand tool case, which has a mounting surface side and at least one hand tool socket, and includes a clip member detachably mounted thereto and a mounting arrangement provided at said mounting surface side and configured to be detachably attaching to said first attachable surface side of said card holder case, and at least one hand tool configured to be selectively received in said at least one hand tool socket and removed from said at least one hand tool socket, wherein said clip member has a ring shape holder for retaining an element in position.

* * * * *